United States Patent [19]

Chase

[11] 4,138,829

[45] Feb. 13, 1979

[54] DISCHARGE VANE ARRANGEMENT FOR A POWERED SNOW THROWER

[75] Inventor: Alan L. Chase, Oostburg, Wis.

[73] Assignee: Allis-Chalmers Corporation, Milwaukee, Wis.

[21] Appl. No.: 880,990

[22] Filed: Feb. 24, 1978

[51] Int. Cl.[2] ..... E01H 5/00

[52] U.S. Cl. ..... 37/43 D; 193/2 A

[58] Field of Search ..... 37/43 R, 43 A–43 L, 37/20–27; 193/2 R, 2 A, 28–30, 33–34

[56] References Cited

U.S. PATENT DOCUMENTS

| | | | |
|---|---|---|---|
| 3,359,661 | 12/1967 | Speiser et al. | 37/43 D |
| 3,452,460 | 7/1969 | Cope et al. | 37/43 D |

FOREIGN PATENT DOCUMENTS

| | | | |
|---|---|---|---|
| 845605 | 7/1956 | Canada | 37/43 R |
| 416726 | 12/1946 | Italy | 37/43 D |
| 123618 | 12/1948 | Sweden | 37/43 D |

*Primary Examiner*—E. H. Eickholt

*Attorney, Agent, or Firm*—Charles L. Schwab

[57] ABSTRACT

A compact, lightweight snow thrower having a power driven impeller rotating about a horizontal, transverse axis to throw snow upwardly and forwrdly through a chute which is substantially coextensive in width with the axial length of the impeller. A plurality of laterally spaced upright vanes are disposed in and pivotally connected to the upper end of the chute for the purpose of directing the discharge of snow. The vanes are pivotally connected to a control bar whereby movement of the control bar effects simultaneous lateral tilting of the vanes. The vanes include a centrally positioned set which are parallel to one another and a pair of vanes at each of the laterally opposite sidewalls of the chute which are disposed at upwardly converging angles to one another so as to compress the column of discharged snow. One of the sidewalls of the discharge chute is also inclined laterally inwardly in an upward direction. The two laterally opposite, outermost vanes cause a converging effect on the snow being discharged to avoid wide dispersion of the discharged snow.

6 Claims, 8 Drawing Figures

DISCHARGE VANE ARRANGEMENT FOR A POWERED SNOW THROWER

RELATED APPLICATIONS

Other features of the snow thrower disclosed herein are shown in my copending patent applications of even filing date entitled "Vane Adjusting Mechanism For a Powered Snow Thrower" and "Snow Thrower With Combined Discharge Vane Support and Strike-Off Wall."

TECHNICAL FIELD OF THE INVENTION

This invention relates to a walk-behind snow thrower of the type having a powered impeller which rotates about a horizontal transverse axis to throw snow upwardly and forwardly through a discharge chute.

BACKGROUND OF THE INVENTION

Lightweight snow throwers of a type using a powered impeller disposed on a transverse horizontal axis and an upwardly and forwardly directed discharge chute with directional vanes are shown in U.S. Pat. No. Des. 241,762 to Darrel W. Hinklin, Snow Thrower, issued Oct. 5, 1976; U.S. Pat. No. Des. 205,531 to Byron L. Ertsgaard and John A. Gale, Snow Plow, issued Aug. 16, 1966; U.S. Pat. No. Des. 209,305 to Byron L. Ertsgaard and John A. Gale, Snow Plow Housing, issued Nov. 21, 1967; U.S. Pat. No. Des. 208,199 to Byron L. Ertsgaard and John A. Gale, Snow Plow Housing, issued Aug. 1, 1967; U.S. Pat. No. 3,359,661 to R. W. Speiser et al., Powered Implement, issued June 30, 1964; U.S. Pat. No. 3,452,460 to J. M. Cope et al., Impeller For Rotary Snow Removal Apparatus, issued July 1, 1969; and Norwegian Pat. No. 74,014 issued Sept. 27, 1948. Vehicular mounted snow throwers having vanes for directing the discharge of snow are shown in U.S. Pat. No. 2,498,522 to E. J. Berg et al., Rotary Snow Plow, issued Feb. 21, 1950, and U.S. Pat. No. 2,706,864 to A. T. Kear, Discharge Chute For Rotary Snow Plow, issued Apr. 26, 1955.

SUMMARY OF THE INVENTION

A discharge directing mechanism is provided for a snow thrower of the type including a housing, an impeller mounted in the housing for rotation of a horizontal transverse axis and power means for rotating the impeller to achieve a discharge of snow. The discharge directing mechanism includes walls in the housing defining an upwardly open, forwardly inclined discharge chute which extends transversely substantially coextensive with the impeller. A plurality of laterally spaced, upright vanes are included in the chute and supported on the housing for lateral tilting movement between an intermediate position in which the discharge of snow is directed forwardly and upwardly, a first laterally tilted position for directing the discharge to one lateral side and a second laterally tilted position for directing the discharge to the opposite lateral side. The laterally outermost vanes are disposed in upwardly converging relation to one another to assist in maintaining good directional control of the column of discharged snow.

The vanes may be pivoted at their upper ends to the top of the front and rear walls of the discharge chute and the upper ends of the vanes may be substantially coterminous with the top of the chute.

One of the problems concerning lightweight snow throwers using a transverse impeller and coextending discharge is that the discharged snow is dispersed over a wider area than is desired. In the present invention, the converging vanes cause a slight converging of the snow as it leaves the snow thrower, thus reducing dispersion and permitting the operator to more accurately direct and deposit the discharged snow.

BRIEF DESCRIPTION OF THE DRAWINGS

One embodiment of the invention is illustrated in the drawings in which.

DETAILED DESCRIPTION OF THE INVENTION

Figure 1:
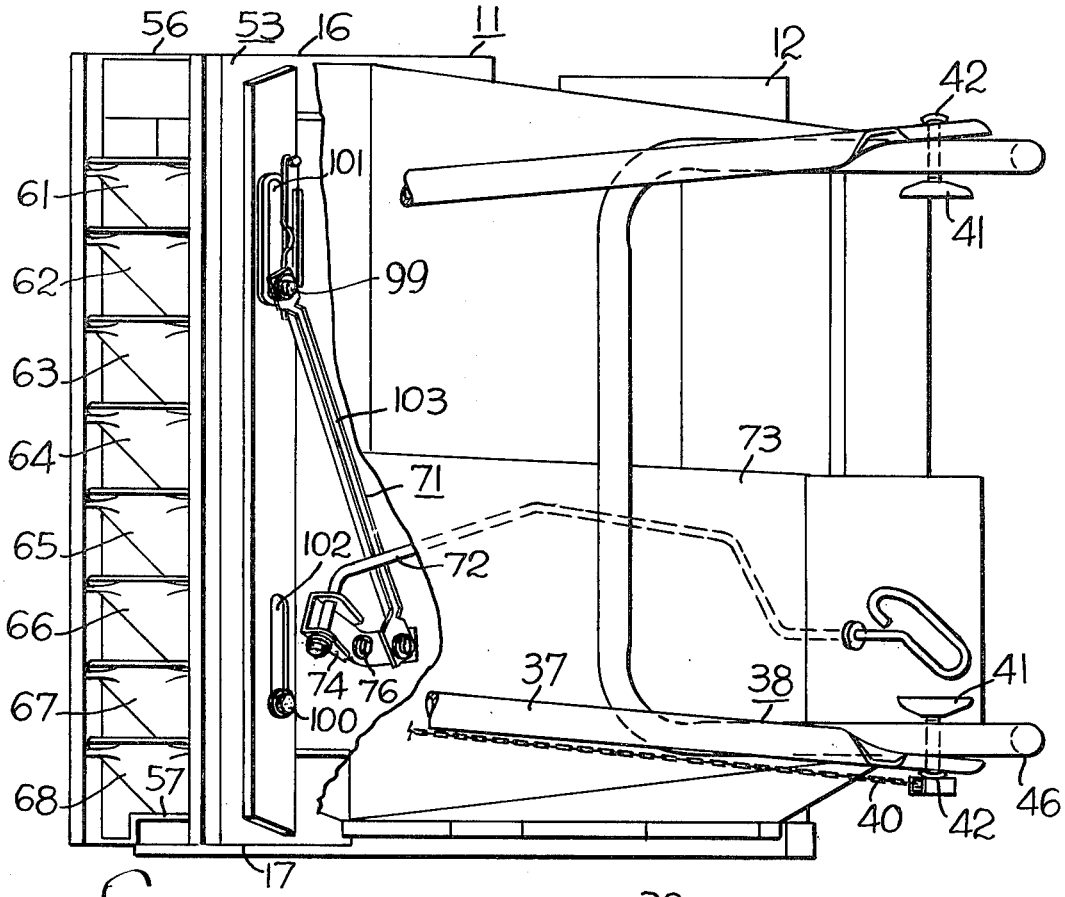
FIG. 1 is a top view of the lightweight snow thrower incorporating the present invention.
Figure 2:
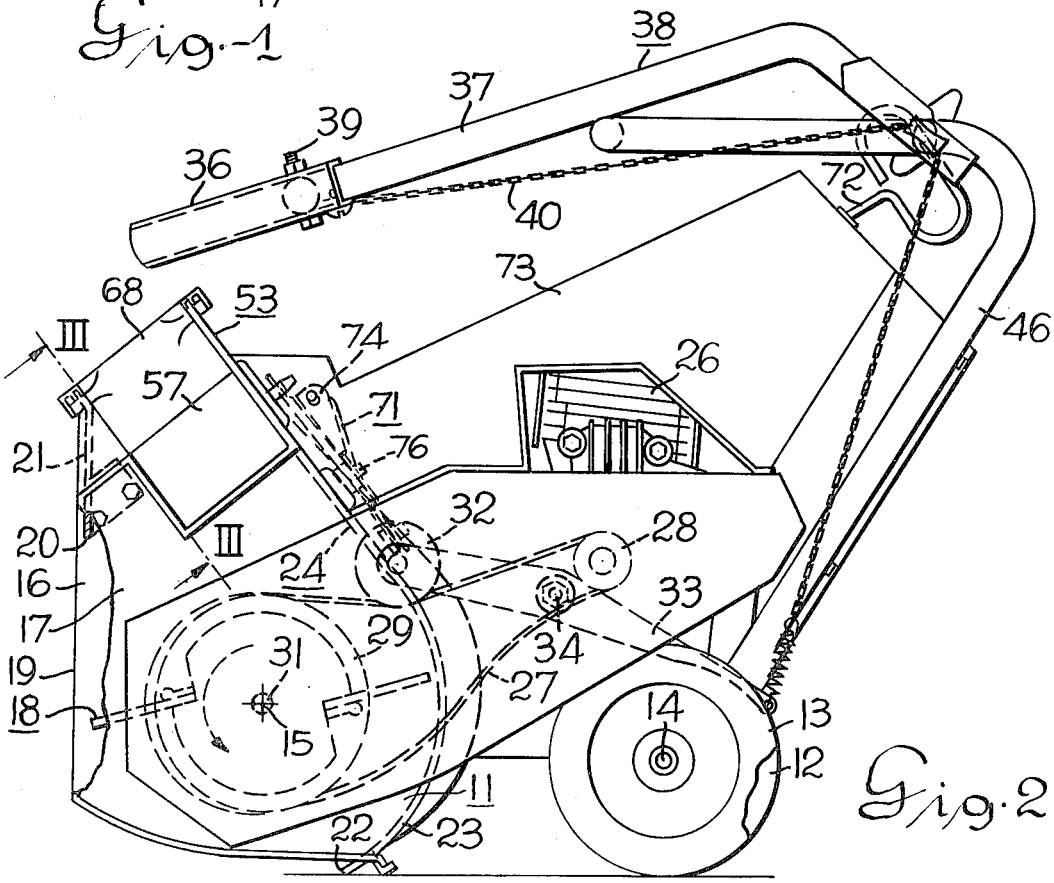
FIG. 2 is a left side view of the snow thrower illustrated in FIG. 1.
Figure 7:
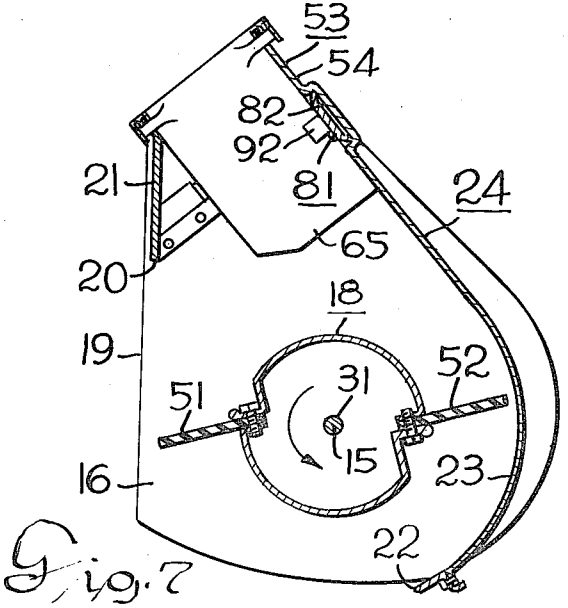
FIG. 7 is a section view taken along the line VII—VII in FIG. 6.
Figure 6:
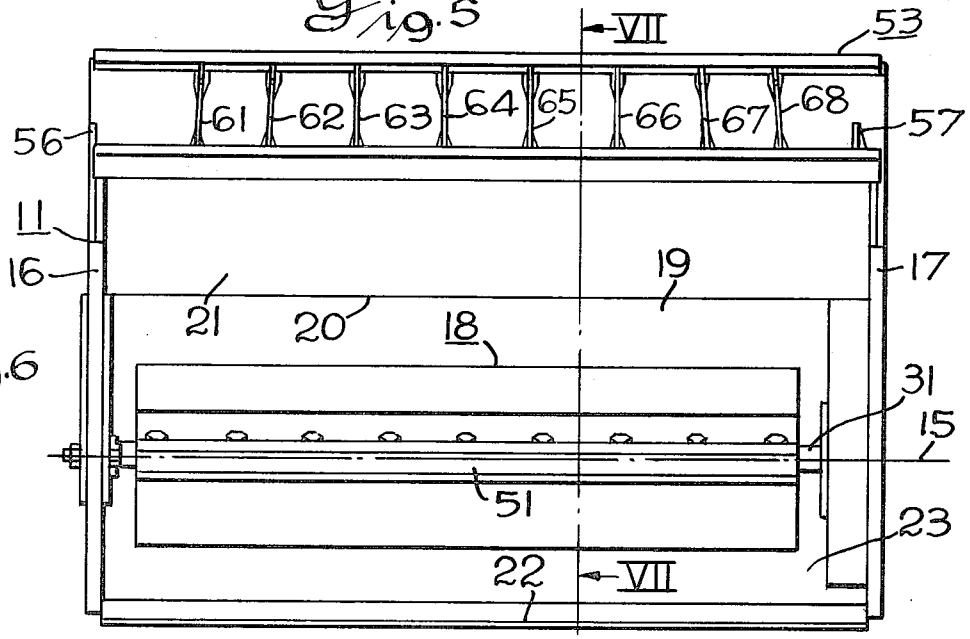
FIG. 6 is a partial front view of the snow thrower illustrated in FIGS. 1 and 2 with the vanes adjusted to a forward discharge position.

As illustrated in FIGS. 1 and 2, the lightweight snow thrower of the present invention includes a housing 11. The snow thrower is supported on a pair of laterally spaced wheels 12, 13 mounted on the housing 11 for rotation about a transverse axis 14. The housing 11 includes a pair of vertical walls 16, 17 at laterally opposite sides of the snow thrower which support the shaft 31 of an impeller 18 by suitable bearings (not shown) for rotation about a horizontal, transverse axis 15. Referring also to FIGS. 6 and 7, a forwardly opening entryway 19 is provided for snow to enter the snow thrower as it is pushed forwardly by a walk-behind operator. The entryway 19 is formed by the vertical walls 16, 17, the lower edge 20 of a front wall 21 and a transverse scraper edge 22 at the bottom end of a lower curved part 23 of a rear wall 24. The impeller 18 is driven by a small, air cooled, internal combustion engine 26 through a drive train which includes a V-belt 27 cooperably engaging the engine drive pulley 28 and a driven V-belt pulley 29 secured to the shaft 31 of the impeller 18. The drive belt 27 is selectively tightened by a clutching idler pulley 32 which is rotatably mounted on a clutch lever 33. The clutch lever 33 is pivotally mounted on the housing by a pin 34 and is selectively operated by a manual control handle 36 pivotally mounted on the upper part 37 of a two-piece handle 38 by a bolt 39. The lever 36 is connected to the rear end of the clutch lever 33 by a suitable flexible control member such as the illustrated chain 40. The two-piece handle 38 is shown in a folded, storage position. When the upper part 37 is pivoted upwardly and rearwardly relative to the lower part 46 to an operating position and the wing nuts 41 are tightened on the pivot bolts 42, the snow thrower may be operated by a person walking behind it. The lower part 46 of the handle 38 is secured at its lower end by means (not shown) to the housing 11.

Figure 3:
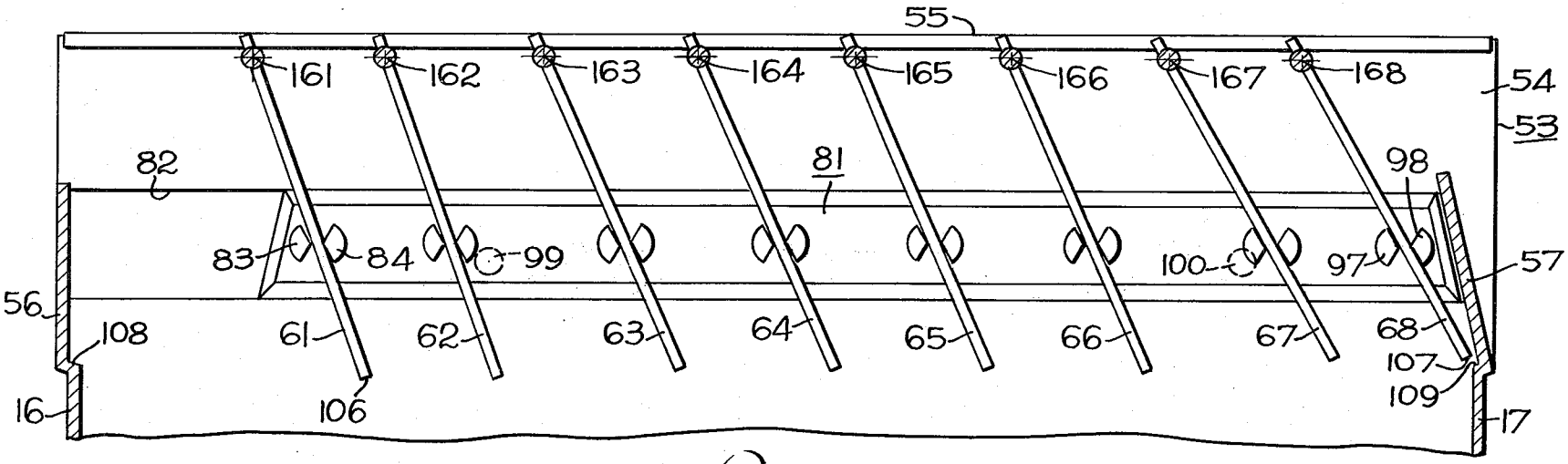
FIG. 3 is a section view taken along the line III—III in FIG. 2.

The impeller 18 is rotated in a counterclockwise direction as viewed in FIGS. 2 and 7 and the two transverse rubber-like paddles 51, 52 throw the snow upwardly through a forwardly and upwardly disposed discharge chute 53. The chute is defined by a flat upper wall portion 54 of the rear wall 24, the front wall 21 and a pair of sidewalls 56, 57 which are, in effect, continuations of walls 16 and 17, respectively. The lateral dimension of the discharge chute 53 is substantially coextensive with the axial length of the impeller 18. Referring also to FIG. 3, the discharge of snow from the chute 53 is controlled by a plurality of vanes 61–68. The upper ends of the vanes 61–68 are approximately coterminous with the upper ends of the front and rear walls 21, 54 of the chute 53. In order to permit lateral tilting adjustment of the vanes 61–68, the upper ends are pivotally connected at the upper ends of the front and rear walls 21, 54 of the chute 53 on a plurality of parallel, laterally spaced axes 161–168.

A manually operated vane adjusting mechanism 71 includes a manually operated control rod 72 pivotally mounted in a cover portion 73 of the housing 11 which has its lower end connected to a control lever 74 pivotally mounted on the housing 11 by a bolt 76. The vane adjusting mechanism 71 also includes laterally shiftable control element in the form of a control bar 81 which fits within a recess 82 in the back wall 54 of the discharge chute 53 a predetermined distance from the upper end 55 of the latter. The control bar 81 includes a plurality of finger parts 83–98 which project forward from the control bar 81 to engage opposite sides of the vanes. The finger parts act in pairs to space the vanes laterally of one another and serve as fulcrums or lateral thrust transmitting parts to cause the vanes to tilt laterally when the control bar 81 is adjusted laterally in the recess 82.

It will be noted that the finger parts 83, 84 and 97, 98 serve to space the laterally outermost vanes 61 and 68 further apart laterally at the control bar than the lateral spacing of the vanes 61 and 68 at their upper pivot connections with the chute, thus providing the upwardly convering relationship between the vanes 61 and 68. The bar 81 has a pair of rearwardly projecting, cylindrical knobs 99, 100 which extend through slots 101, 102 in the rear wall 54. A control link 103 is pivotally connected at one of its ends to knob 99 and at the other of its ends to a lower end of the control lever 74.

OPERATION AND USE OF THE INVENTION

Figure 4:
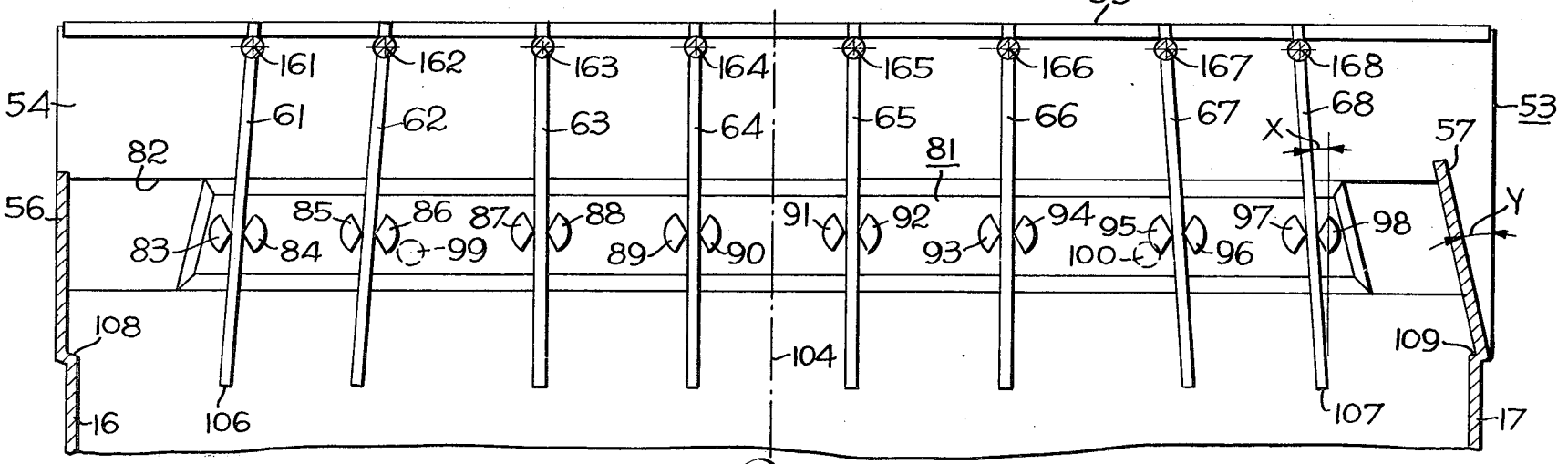
FIG. 4 is a view similar to FIG. 3 but showing the vanes adjusted to a forward discharge position.

When the operator adjusts the vanes 61–68 by the manually operated vane adjusting mechanism 71 to the straight ahead discharge position shown in FIG. 4, the snow thrown upwardly and forwardly through the chute 53 by the impeller will be directed by the vanes 61–68 in a generally upward and forward direction. It will be noted that the vanes 61, 62, 67, 68 are laterally inwardly inclined toward the centerline 104 of the snow thrower. In other words, in FIG. 4 the vanes 61, 62 are in upwardly converging relation to vertically disposed, parallel vanes 63–66. Vanes 67, 68 are also in upwardly converging relation to vanes 63–66. The four centrally disposed vanes 63–66, being vertically disposed, direct the snow straight ahead of the snow thrower. The vanes 61, 62, being in upwardly converging relation to vanes 67, 68, will cause the laterally opposite sides of the column of discharged snow to be angled slightly inwardly to slightly compress the column. This reduces the scattering of discharged snow and permits a more accurate placement of the discharged snow. The angle of convergence of the vanes 61, 62 and 67, 68 is slight so that the convergence of snow does not unduly interfere with the throw of the discharged snow. As illustrated in FIG. 4, the vanes 61, 62, 67, 68 are inclined toward the central longitudinal vertical plane 104 of the snow thrower at an angle x of 4.5 degrees. The sidewall 57 is laterally inclined inwardly at a slightly greater angle of y of 13 degrees. The sidewall 57 assists the converging vanes 61, 62, 67, 68 in converging the discharged snow into a reasonably well defined column.

Figure 8:
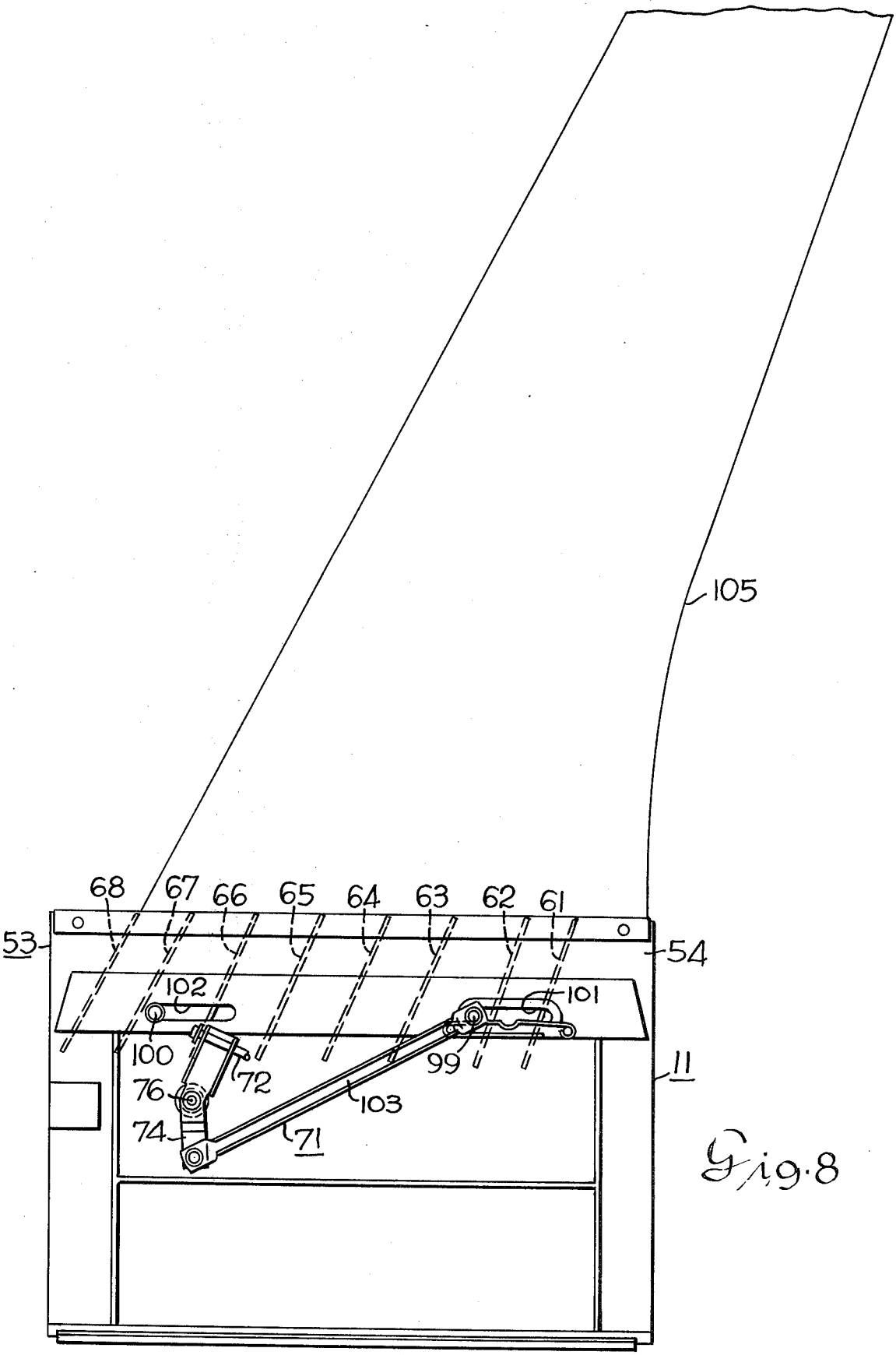
FIG. 8 is a schematic rear view of the snow thrower showing the vanes adjusted to a right discharge position and illustrating the converging effect caused by the discharge converging vanes upon the column of discharged snow.

When the vanes are adjusted to the position shown in FIG. 3 by lateral shifting movement of the control bar 81, the vanes are tilted laterally by the finger parts 83–98 to cause a discharge snow from the right side of the snow thrower, as viewed by a walk-behind operator. In this position of adjustment, the two laterally outer vanes 61, 62 and 67, 68 at the laterally opposite sides are disposed in upwardly converging relation to one another and in relation to the centrally disposed vanes 63, 64, 65, 66. Thus, the column of snow discharged to the right of the snow thrower will be compressed by the converged snow directed by the converging vanes 61, 62, 67, 68 to reduce scattering and provide good directional control to the discharged column of snow. The converged column of discharged snow 105 is schematically illustrated in FIG. 8. It will be noted that the sidewall 56 assists in converging the column of discharged snow when the vanes are adjusted to discharge to the right.

Figure 5:
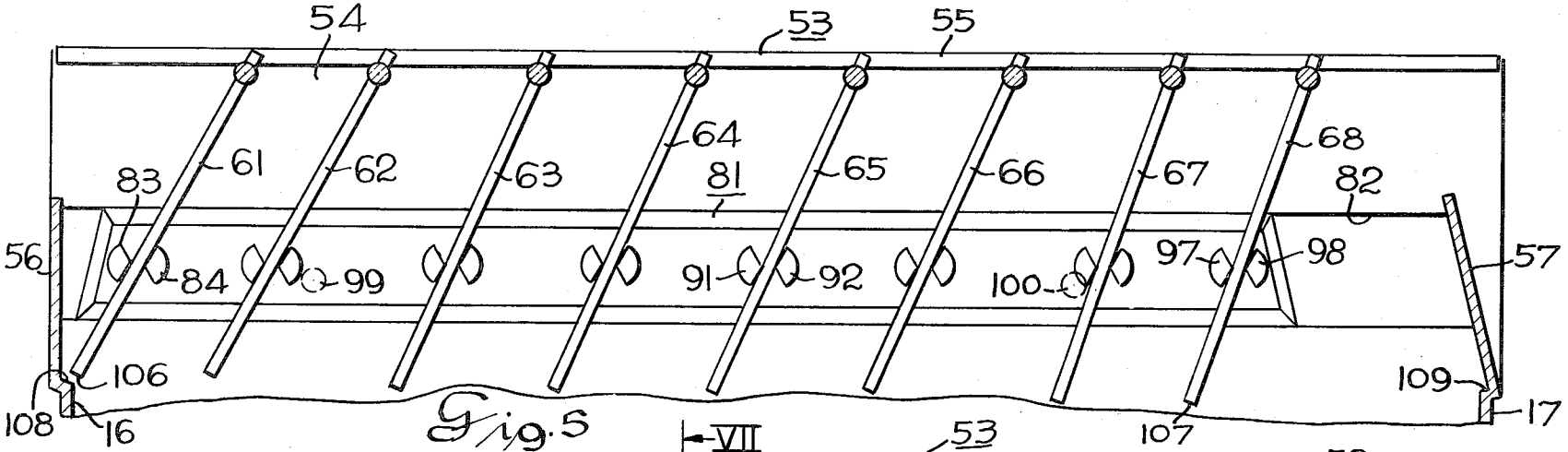
FIG. 5 is a view similar to FIGS. 3 and 4 but showing the vanes adjusted to discharge snow to the left side of the snow thrower.

Referring to FIG. 5, converging vanes 61, 62, 67, 68 provide the same converging effect when the vane control bar 81 is shifted in the opposite lateral direction to position the vanes 61–68 for discharge of snow to the left (as viewed by the walk-behind operator).

When the vanes are adjusted to the right and left, the bottom edges 106, 107 of vanes 61, 68 are disposed closely adjacent to the sidewalls 56, 57, respectively, and preferably will be disposed, respectively, in the recesses 108, 109 in the walls 16, 17 at the junction of the lower ends of sidewalls 56, 57 and the walls 16, 17 so as to minimize resistance to discharge of snow through the chute 53.

From the foregoing description, it is believed apparent that a novel vane mechanism for a snow thrower has been provided wherein the two laterally outermost vanes at each side cause the column of discharged snow to be compressed slightly at its lateral sides to prevent an excessively wide dispersion of snow. The slight upward convergence of the two pairs of laterally opposite outermost vanes permits a more accurate placement of the discharged snow.

The embodiments of the invention in which an exclusive property or privilege is claimed are defined as follows:

1. A vane arrangement for a snow thrower of the type including a housing, an impeller mounted in the housing for rotation about a transverse axis, power means for rotating the impeller and walls in the housing defining an upwardly open, forwardly inclined discharge chute disposed above and extending transversely substantially coextensive with the impeller, the vane arrangement characterized by:

a plurality of laterally spaced, upright vanes in said chute supported on said housing for lateral tilting movement between an intermediate position for directing the discharge straight ahead and oppositely pitched laterally tilted positions for directing the discharge to one lateral side or the other, the laterally outermost of said vanes being disposed in upwardly converging relation to one another, and a vane adjusting mechanism connected to said vanes for simultaneously adjusting the latter between said positions.

2. The snow thrower of claim 1 wherein said laterally outermost vanes are disposed in upwardly converging relation to the vanes in the central part of said discharge chute and deflect the snow laterally inwardly thereby compressing the width of the column of snow discharged by the snow thrower.

3. The snow thrower of claim 1 wherein said housing includes laterally opposite sidewalls partially defining said chute, at least one of said sidewalls inclining laterally inwardly in its upward direction.

4. The snow thrower of claim 1 wherein said vanes are pivotally connected at their upper ends to said housing near the upper end of said chute.

5. The snow thrower of claim 4 wherein said vanes are substantially coterminous with the upper end of said chute.

6. The snow thrower of claim 1 wherein said vanes are pivotally connected to said housing for tilting movement about parallel axes and wherein said vane adjusting mechanism includes a laterally shiftable control element with laterally spaced parts engaging said vanes, respectively, the lateral distance between the outermost vanes at their pivot connections with said housing being less than the lateral distance between said outermost vanes at their connections with said control element.

* * * * *